US010161275B2

(12) United States Patent
Pellicone et al.

(10) Patent No.: US 10,161,275 B2
(45) Date of Patent: Dec. 25, 2018

(54) COMPACT MUFFLER HAVING MULTIPLE REACTIVE CAVITIES PROVIDING MULTI-SPECTRUM ATTENUATION FOR ENHANCED NOISE SUPPRESSION

(71) Applicant: SECOR LIMITED, Horsham, PA (US)

(72) Inventors: Dane Pellicone, Ivyland, PA (US); Ronald Mangus, Jr., Morrisville, PA (US)

(73) Assignee: SECOR LIMITED, Horsham ( * ) Notice: Subject to any disclaimer, the term of this patent is extended or adjusted under 35 U.S.C. 154(b) by 63 days.

(21) Appl. No.: 15/374,088

(22) Filed: Dec. 9, 2016

(65) Prior Publication Data

US 2017/0167332 A1 Jun. 15, 2017

Related U.S. Application Data

(60) Provisional application No. 62/266,923, filed on Dec. 14, 2015.

(51) Int. Cl.
*F01N 1/08* (2006.01)
*F01N 1/02* (2006.01)

(52) U.S. Cl.
CPC ..... *F01N 1/083* (2013.01); *F01N 1/02* (2013.01); *F01N 1/026* (2013.01); *F01N 2470/02* (2013.01); *F01N 2470/24* (2013.01)

(58) Field of Classification Search
CPC ..... F01N 1/083; F01N 1/026; F01N 2470/08; F01N 2470/24; F01N 2490/14
USPC ..... 181/248, 250, 251, 272, 273, 276
See application file for complete search history.

(56) References Cited

U.S. PATENT DOCUMENTS

| | | | | |
|---|---|---|---|---|
| 3,680,660 | A * | 8/1972 | DuBois | F01N 1/003 181/250 |
| 3,739,874 | A * | 6/1973 | Plaga, III | F01N 1/02 181/250 |
| 4,501,341 | A | 2/1985 | Jones | |
| 5,350,888 | A | 9/1994 | Sager | |
| 5,783,780 | A * | 7/1998 | Watanabe | F02M 35/1272 181/229 |
| 5,952,625 | A | 9/1999 | Huff | |
| 7,798,286 | B2 | 9/2010 | Skowronski | |
| 8,485,314 | B2 * | 7/2013 | Danner | F01N 1/026 181/246 |
| 8,800,713 | B2 * | 8/2014 | Keesser | F01N 1/023 181/246 |

* cited by examiner

*Primary Examiner* — Jeremy Luks
(74) *Attorney, Agent, or Firm* — FisherBroyles, LLP

(57) ABSTRACT

A reactive muffler having multiple structures tuned to multiple frequency ranges or characteristics, and thus providing attenuation over a band of frequencies broader than a conventional reactive muffler. The present invention provides such a muffler by providing structures internal to the muffler skin that define multiple different volumes/cavities, each of which is tuned to provide distinctly different attenuation characteristics. In effect, the inventive muffler acts as multiple distinctly different mufflers providing distinctly different noise attenuation, though packaged within a single muffler skin/body.

16 Claims, 7 Drawing Sheets

COMPACT MUFFLER HAVING MULTIPLE REACTIVE CAVITIES PROVIDING MULTI-SPECTRUM ATTENUATION FOR ENHANCED NOISE SUPPRESSION

CROSS-REFERENCE TO RELATED APPLICATION

This application claims the benefit of priority, under 35 U.S.C. § 119(e), of U.S. Provisional Patent Application No. 62/266,923, filed Dec. 14, 2015, the entire disclosure of which is hereby incorporated herein by reference.

FIELD OF THE INVENTION

The present invention relates generally exhaust system muffler for internal combustion engines that is configured for suppression of noise in at least two distinct frequency ranges.

BACKGROUND

Internal combustion engines generate exhaust gases and associated noise due to the sudden expansion of combustion chamber exhaust gases. It is commonly desirable to suppress or "muffle" the noise caused by the engine. Various approaches have been used to design mufflers for limiting the sound pressure level of exhaust noise.

One conventional approach is a dissipative muffler. Dissipative mufflers generally include ducts or chambers filled with acoustic absorbing materials. These materials absorb the acoustic energy and transform it into thermal energy. However, the sound absorbing material tends to break down over time due to physical and thermal stresses, and this leads to a degradation in muffler performance. Further, when this approach creates a substantial increase in back pressure, or resistance of the muffler to the free discharge of the combustion gasses. This increase in backpressure can result in a decrease in the output horsepower of the engine with a resulting loss of efficiency in fuel economy, which are undesirable.

Another approach is a reactive muffler. Reactive mufflers generally include a number of resonating chambers of different volumes and shapes connected with pipes, and may include baffles or flow reversals. However, such configurations commonly cause increased backpressure at the exhaust of the engine that degrades engine performance.

Conventional muffler systems generally fail to attenuate sound waves over a broad band of frequencies. Mufflers typically provide effective attenuation only at specified frequencies equal to or greater than a specific cut-off frequency. Exemplary dissipative mufflers provide effective attenuation only above approximately 500 Hertz. As a result, the typical dissipative muffler fails to attenuate low frequency sound. This failure is unacceptable in an automobile exhaust muffler because the sound produced by the engine has greatest amplitude at lower frequencies, such as below approximately 500 Hertz. The transmission loss of a typical reactive muffler or expansion is characterized by a periodic series of sinusoidal "humps." As a result, a reactive muffler provides acceptable amplitude levels of low frequency attenuation, but is by its nature tuned to a single frequency (or frequency range, or frequency characteristic), and thus provides essentially no attenuation at other frequencies.

FIG. 1 is an exploded view showing an exemplary prior art reactive muffler 10 including a tubular outer skin 20 that, when assembled, is closed at both ends by upstream end cap

23 and downstream end cap 24. Each end cap defines a respective opening 26, 28, but otherwise closes an open end of outer skin 20 when assembled. In use in an exhaust system, inlet opening 26 in upstream end cap 23 is mated to exhaust ducting to admit exhaust gases into muffler 10, and outlet opening 28 in downstream end cap 24 is mated to exhaust ducting (or directly to atmosphere), to expel exhaust gases from the muffler 10.

Sleeve tube 30 has a necked-down portion 32 at its upstream end. The outer periphery, e.g., diameter of the necked-down portion is configured to correspond to and fit closely with the inner diameter of the inlet opening 26 in the upstream end cap 23. The inner periphery, e.g., diameter, of the necked-down portion 32 is configured to correspond to and fit closely with the outer diameter of an upstream end 42 of the internal tube 40. When assembled, end cap 23, sleeve tube 30 and internal tube 40 are joined, e.g., by welding, so that gases admitted through inlet opening 26 travel through the internal tube 40.

The downstream end 44 of internal tube 40 has an outer periphery, e.g., diameter, configured to correspond to and fit closely with the inner diameter of the outlet opening 28 in downstream end cap 24. Internal tube 40 is joined to end cap 24, e.g., by welding, so that gases expelled from internal tube 40 exit the muffler 10 through outlet opening 28.

Notably, the main body portion 34 of sleeve tube 30 has an inner diameter/surface that is larger than an outer diameter/surface of internal tube 40, and the length of sleeve tube 30 is shorter than a length of internal tube 40 so that sleeve tube 30 does not abut downstream end cap 24. Further, internal tube 40 includes at least one, and preferably multiple, and more preferably a pair of opposed, openings 46, 48, defined in the sidewall of the internal tube 40.

This creates an air gap between sleeve tube 30 and internal tube 40, and a conduit that provides fluid communication from the inlet opening 26, through the internal tube 40, through openings 46 and 48, between the sleeve tube 30 and internal tube 40, and into the second volume of the skin, as well as from the second volume of the skin 20, between the sleeve tube 30 and internal tube 40, through the opening(s) 46, 48, and through the internal tube 40 to and through the outlet opening 28. This conduit provides a continuous volume, or cavity, that can be configured/tuned for noise suppression purposes. This continuous volume is defined as the internal volume of the skin 20 and end caps 23, 24.

Accordingly, this muffler provides internal structure functioning as a modified side branch resonator. By varying the relative sizes (diameters and lengths) of the sleeve and internal tubes, the air gap between them, the volume of the skin 20, and the diameter and placement of the openings in the internal tube, this muffler can be tuned as desired to attenuate a range of frequencies of exhaust-associated noise. The tuning can be performed using the Helmholtz equation to design a resonator comprised of a branch with a given length and volume of air, where the difference in diameters between the internal diameter of the sleeve tube and outer diameter of the internal tube creates a volume of air that can be modeled as a cylinder for the purpose of the Helmholtz equation, as known in the art. However, this design can be tuned to cancel out/attenuate a single frequency or range/set of frequencies according to its design. Accordingly, attenuation design involves a compromise involving design of a muffler having an external volume/configuration that fits within an available envelope of space relative to a remainder of a motor vehicle, etc., while also providing an internal volume and structures providing attenuation of a single target frequency or set of frequencies that are a function of the internal volume.

It is desirable to provide a muffler having the advantages of a reactive muffler, but providing attenuation over multiple ranges of frequencies.

SUMMARY

The present invention provides a reactive muffler having multiple structures tuned to multiple frequency ranges/characteristics, and thus providing attenuation over a band of frequencies broader than a conventional reactive muffler. The present invention provides such a muffler by providing structures internal to the muffler skin that define multiple different volumes/cavities, each of which is tuned to provide distinctly different attenuation characteristics. In effect, the inventive muffler acts as multiple distinctly different mufflers providing distinctly different noise attenuation, though packaged within a single muffler skin/body.

BRIEF DESCRIPTION OF THE DRAWINGS

The present invention will now be described by way of example with reference to the following drawings in which.

DETAILED DESCRIPTION

The present invention provides a reactive muffler tuned to attenuate multiple frequencies, or sets of frequencies, thereby providing attenuation over a range of frequencies broader than a conventional reactive muffler. The reactive muffler of the present invention does so by providing multiple different internal volumes/cavities and structures within a single muffler skin/body, thereby providing attenuation of multiple target frequency or sets of frequencies that are a function of multiple and distinctly different internal volumes/cavities. In essence, a single reactive muffler itself functions for attenuation purposes as multiple reactive mufflers within a single muffler's spatial envelope.

Figure 1:
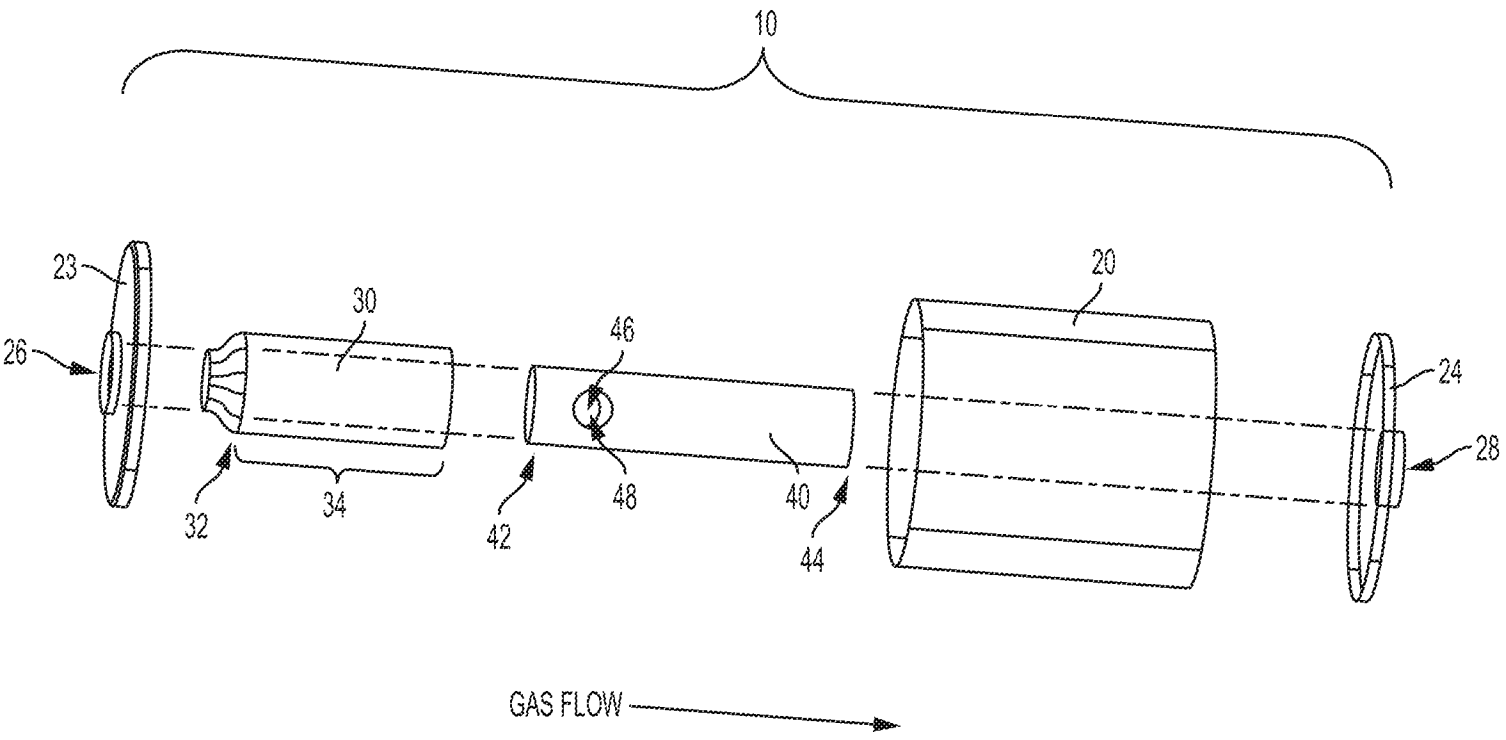
FIG. 1 PRIOR ART
FIG. 1 is a side view of a reactive muffler tuned to attenuate a single range of frequencies that is exemplary of the prior art, showing the components in an exploded view of illustrative clarity.
Figure 2:
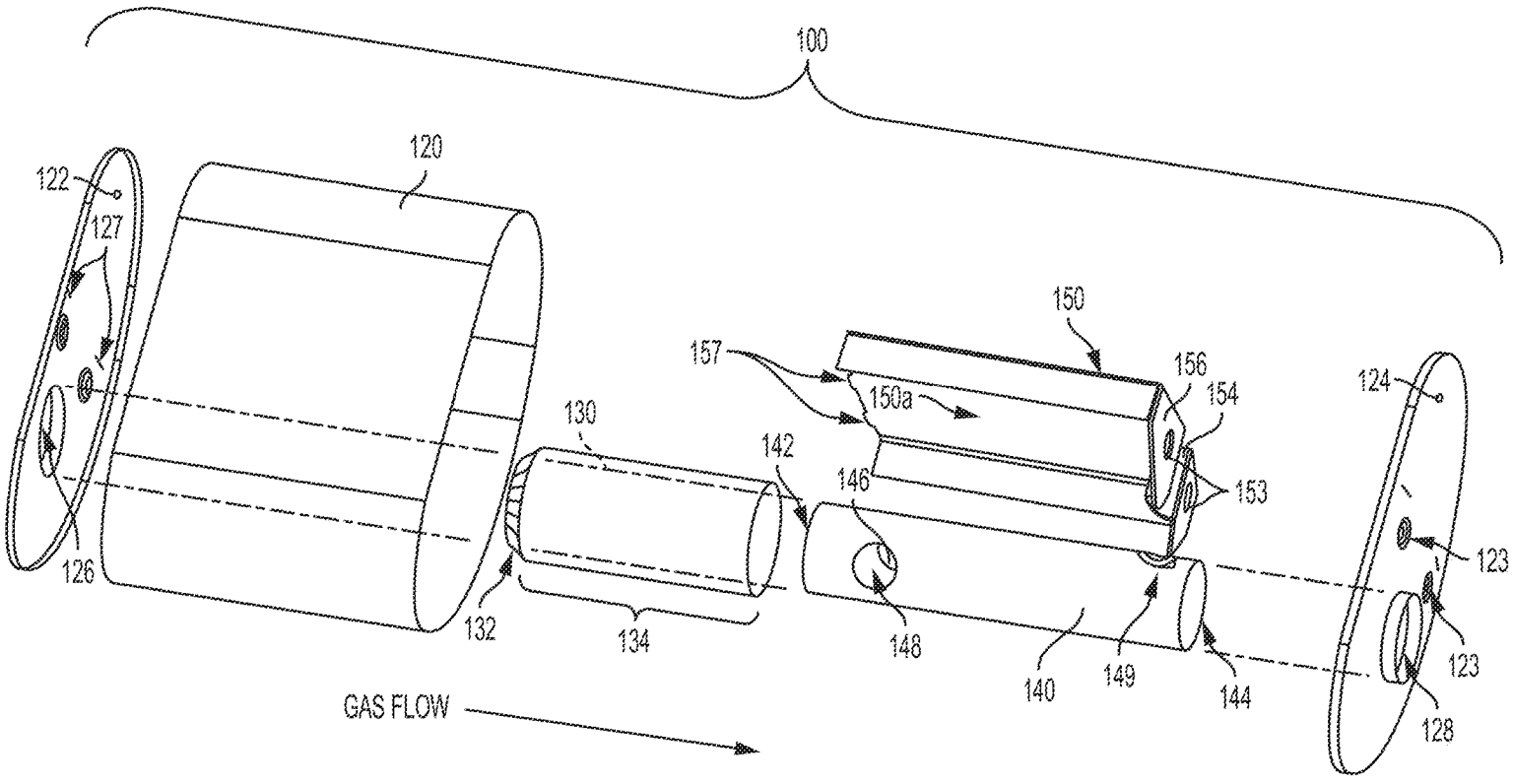
FIG. 2 is a side view of a reactive muffler tuned to attenuate multiple ranges of frequencies in accordance with the present invention, showing the components in an exploded view of illustrative clarity.
Figure 3:
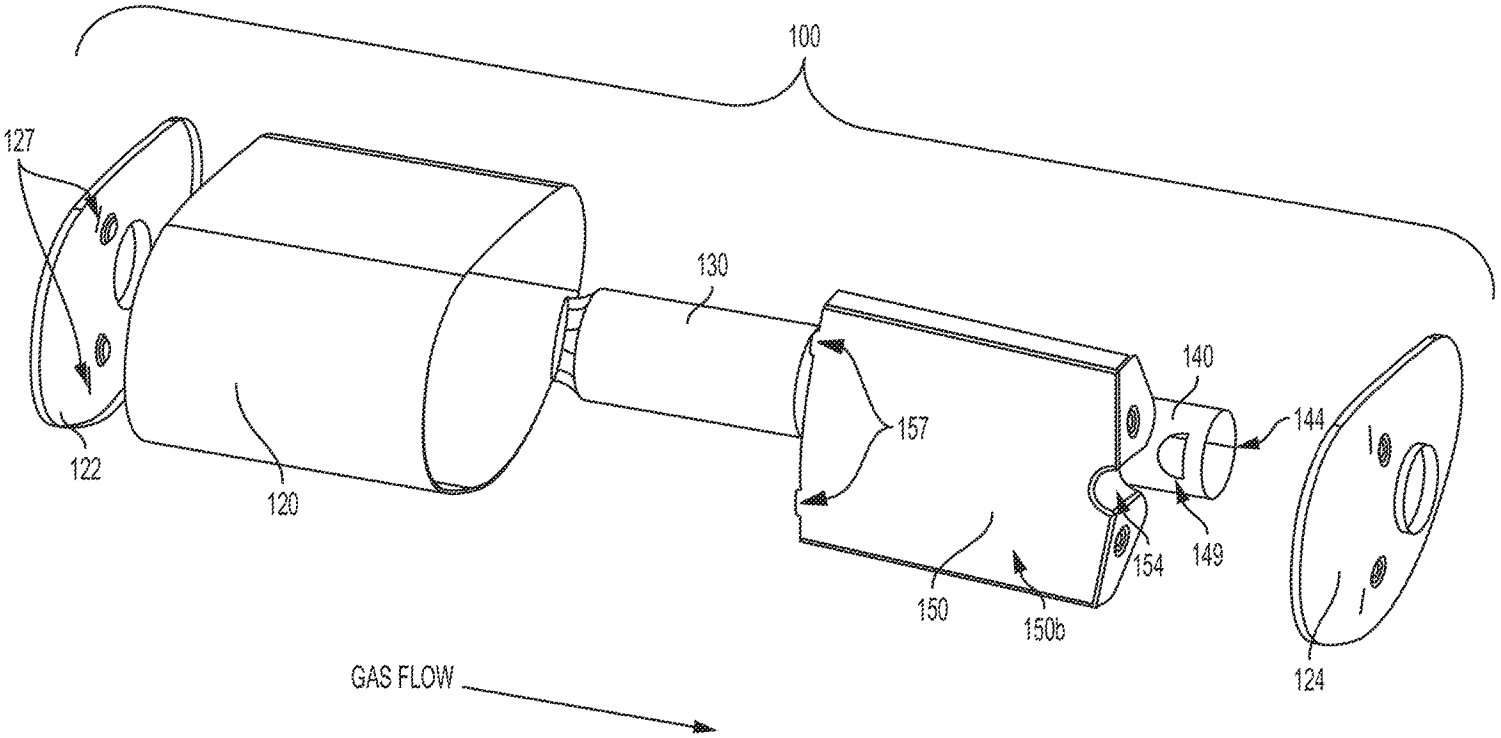
FIG. 3 is an alternative side view of the muffler of FIG. 2.

FIGS. 2 and 3 are side views of an exemplary reactive muffler 100 tuned to attenuate multiple ranges of frequencies in accordance with the present invention, showing the components in an exploded view of illustrative clarity;

Referring now to FIGS. 2 and 3, the muffler 100 of the present invention includes some components similar to those of FIG. 1 (and labelled with similar, but not identical, reference numerals). Accordingly, muffler 100 includes a tubular outer skin 120 that, when assembled, is closed at both ends by upstream end cap 122 and downstream end cap 124. Each end cap defines a respective opening 126, 128, but otherwise closes an open end of outer skin 120 when assembled. In use in an exhaust system, inlet opening 126 in upstream end cap 122 is mated to exhaust ducting to admit exhaust gases into muffler 100, and outlet opening 128 in downstream end cap 124 is mated to exhaust ducting (or directly to atmosphere), to expel exhaust gases from the muffler 100.

Sleeve tube 130 has a necked-down portion 132 at its upstream end. The outer periphery, e.g., diameter of the necked-down portion is configured to correspond to and fit closely with the inner diameter of the inlet opening 126 in the upstream end cap 122. The inner periphery, e.g., diameter, of the necked-down portion 132 is configured to correspond to and fit closely with the outer diameter of an upstream end 142 of the internal tube 140. When assembled, end cap 122, sleeve tube 130 and internal tube 140 are joined, e.g., by welding, so that gases admitted through inlet opening 126 travel through the internal tube 140.

The downstream end 144 of internal tube 140 has an outer periphery, e.g., diameter, configured to correspond to and fit closely with the inner diameter of the outlet opening 128 in downstream end cap 124. Internal tube 140 is joined to end cap 124, e.g., by welding, so that gases expelled from internal tube 140 exit the muffler 100 through outlet opening 128.

Notably, the main body portion 134 of sleeve tube 130 has an inner diameter/surface that is larger than an outer diameter/surface of internal tube 140, and the length of sleeve tube 130 is shorter than a length of internal tube 140 so that sleeve tube 130 does not abut downstream end cap 124. Further, internal tube 140 includes at least one, and preferably multiple, and more preferably a pair of opposed, openings 146, 148, defined in the sidewall of the internal tube 140.

Figure 4:
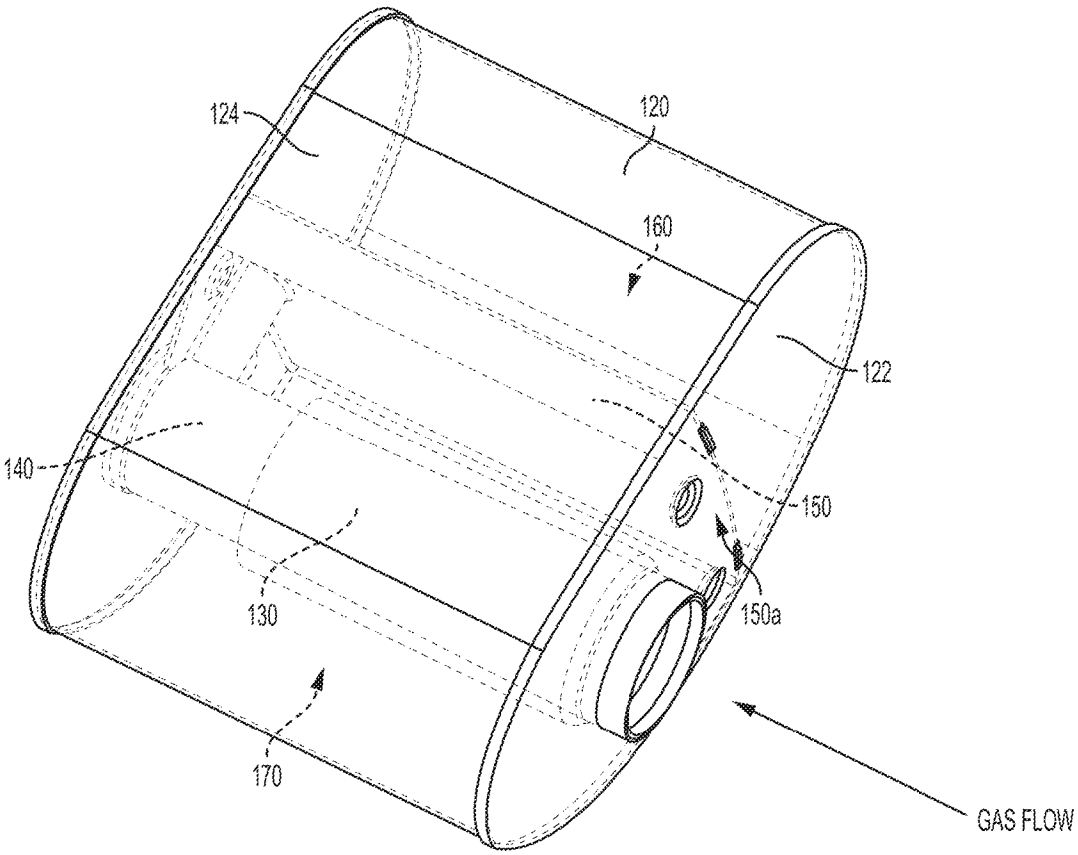
FIG. 4 is a perspective view of the muffler of FIG. 2, shown assembled.
Figure 5:
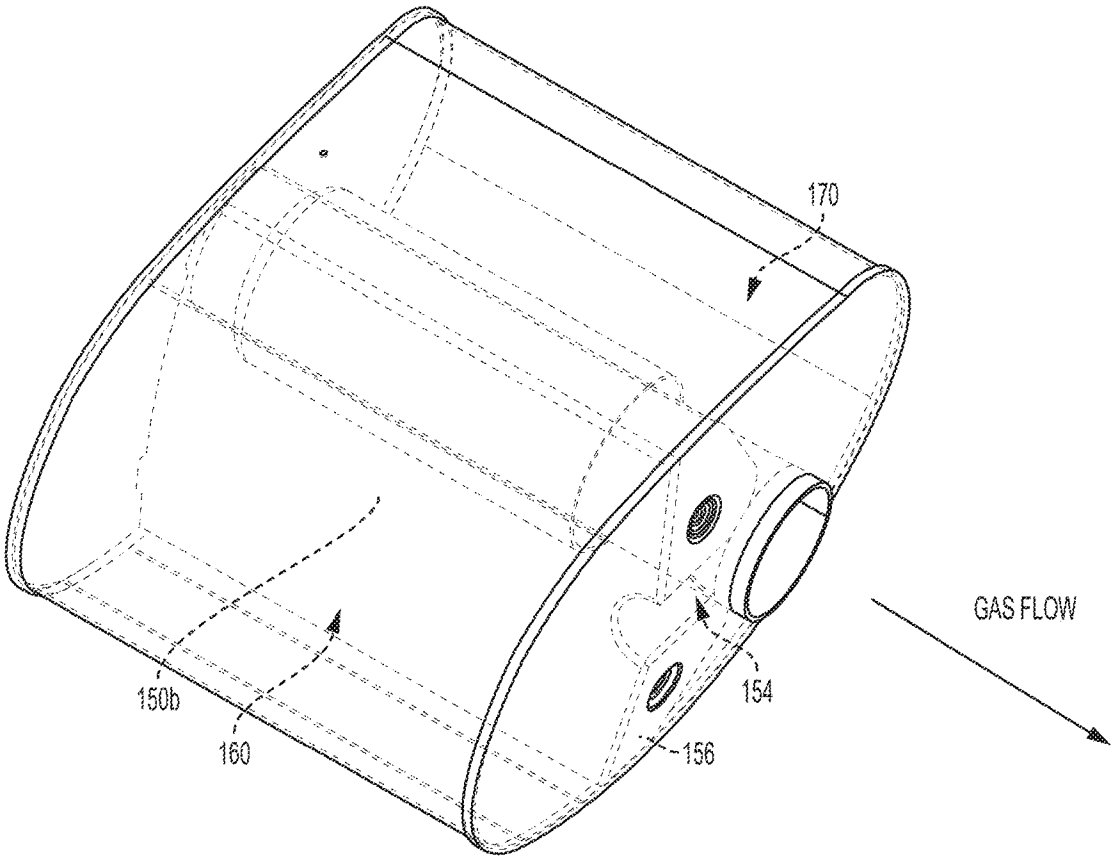
FIG. 5 is an alternative perspective view of the muffler of FIG. 2, shown assembled.

Unlike the prior art muffler 10 described above with reference to FIG. 1, the muffler 100 of the present invention further includes a baffle 150 that extends from the inlet end cap 122 to the outlet end cap 124 to effectively divide an internal volume of the skin 120 into multiple distinct volumes. In this exemplary embodiment, the baffle divides the internal volume of the skin 120 into two different volumes. Referring now to FIGS. 4 and 5, a first cavity 170 having a first volume is defined between a first side 150*a* of the baffle 150, a first portion of the skin 120, and first portions of the end caps 122, 124. A second cavity 160 having a second volume is defines between a second side 150*b*, FIG. 3, of the baffle 150, a second portion of the skin 120, and second portions of the end caps 122, 124.

In this exemplary embodiment, the inlet end cap 122 is provided with a pair of spaced openings 127 acting to support, and align the baffle 150 relative to the skin 120 by receiving complementary protrusions 157 on the baffle. Similarly, the outlet end cap 124 is provided with a pair of bosses 123 acting to support and align the baffle relative to the skin 120 by engaging complementary depressions 153 on the baffle. Any suitable complementary structures may be used as alignment fiducials on the baffle and end caps.

Additionally, unlike the prior art muffler 10 described above with reference to FIG. 1, the internal tube 40 further includes a secondary opening 149. In this exemplary embodiment, the secondary opening 149 is positioned toward an end of the internal tube opposite the end including opening(s) 146/148. The baffle further defines a conduit 154 extending transversely to a direction of elongation of the internal tube. In this exemplary embodiment, the conduit 154 is defined by a sidewall 156 extending transversely to the portion of the baffle extending between the end caps 122, 124. The baffle 150, sidewall 156, conduit 154 and opening 149 cooperate as described below.

Similar to the muffler described above, an air gap is provided between sleeve tube 130 and internal tube 140, and the air gap is part of a first conduit that provides fluid communication from the inlet opening 126, through the internal tube 140, through openings 146 and 148, between the sleeve tube 130 and internal tube 140, and into the first cavity 170 within the skin 120, as well as from the first cavity 170 within the skin 120, between the sleeve tube 130 and internal tube 140, through the opening(s) 146, 148, and through the internal tube 140 to and through the outlet opening 128.

Accordingly, this first cavity 170 and corresponding volume structures provide attenuation of a single target frequency or a first set of frequencies (a first spectrum including the first target frequency) that are a function of this first cavity's internal volume.

Unlike the muffler described above, a second conduit is provided that provides fluid communication from the inlet opening 126, through the internal tube 140, through opening 149, along conduit 154 and into the second cavity 160 within the skin 120, as well as from the second cavity 160 within the skin 120, along the conduit 154, through opening 149, and through the internal tube 140 to and through the outlet opening 128.

Accordingly, this second cavity 160 and corresponding volume and structures provide attenuation of a second target frequency or a second set of frequencies (a second spectrum including the second target frequency) that are a function of this second cavity's internal volume.

By providing distinctly different cavities having distinctly different volumes, the muffler of the present invention is tuned to provide attenuation at multiple different frequencies/frequency ranges (multiple different spectra of noise). Accordingly, this muffler provides attenuation over a broader range of frequencies and provides enhanced noise suppression associated with pressure waves of combustion gasses passing through said muffler from said inlet opening to said outlet opening, within the spatial envelope of a single muffler. Accordingly, the present invention provides a compact muffler having multiple reactive cavities providing multi-spectrum attenuation for enhanced noise suppression.

More specifically, this exemplary inventive muffler cancels out two low frequency signals as a function of the two distinctly different volumes/geometries. As known in the art, this type of muffler acts generally as a Helmholtz resonator according to the Helmholtz equation, and in this case, as two distinctly different Helmholtz resonators. Each is comprised of a branch with a given length and volume of air. As known in the art, adjusting the diameter and length of the branch in addition to adjusting the volume of air will allow for targeting of different frequencies for cancellation/attenuation. This is accomplished by using formula:

$$fr = \sqrt{\frac{D^2C^2}{Vl}}$$

Where
fr=resonant frequency
D=equivalent diameter of the branch tube
C=speed of sound
V=volume of the resonance chamber
l=length of the branch tube In this case, each separate volume as acts as a separate reactive chamber for noise suppression in accordance with the Helmholtz equation, each with its own designed volume and branch.

Chamber 1 internal geometry has been altered from the standard side branch resonator layout to allow for better packaging and aesthetics. The branch tube is concentrically mounted to an internal tube inside the can. The difference in diameters between the ID of the branch tube and the OD of the internal tube creates a volume of air. This volume can then be modeled as a cylinder. Holes in the internal tube are also in place, sized so that the open area is equivalent to the diameter of the theoretical cylinder. This assembly is located inside the chamber with a given volume.

Chamber 2 is constructed as a standard side branch resonator where as there is a branch of a given diameter and a volume of air.

By controlling geometry inside each chamber, the size and location of these key elements, we also control when the sound waves exit the chambers. In essence, the specific timing of when the reflected sound waves re-join the main exhaust flow (which is a function of the length, of the branch, and the volume of the provided conduit) creates a one-hundred-and-eighty-degree out-of-phase sound wave that cancels out problematic frequencies. In other words, these parameters can be selected in concert to provide cancellation of selected problematic frequencies.

Figure 6:
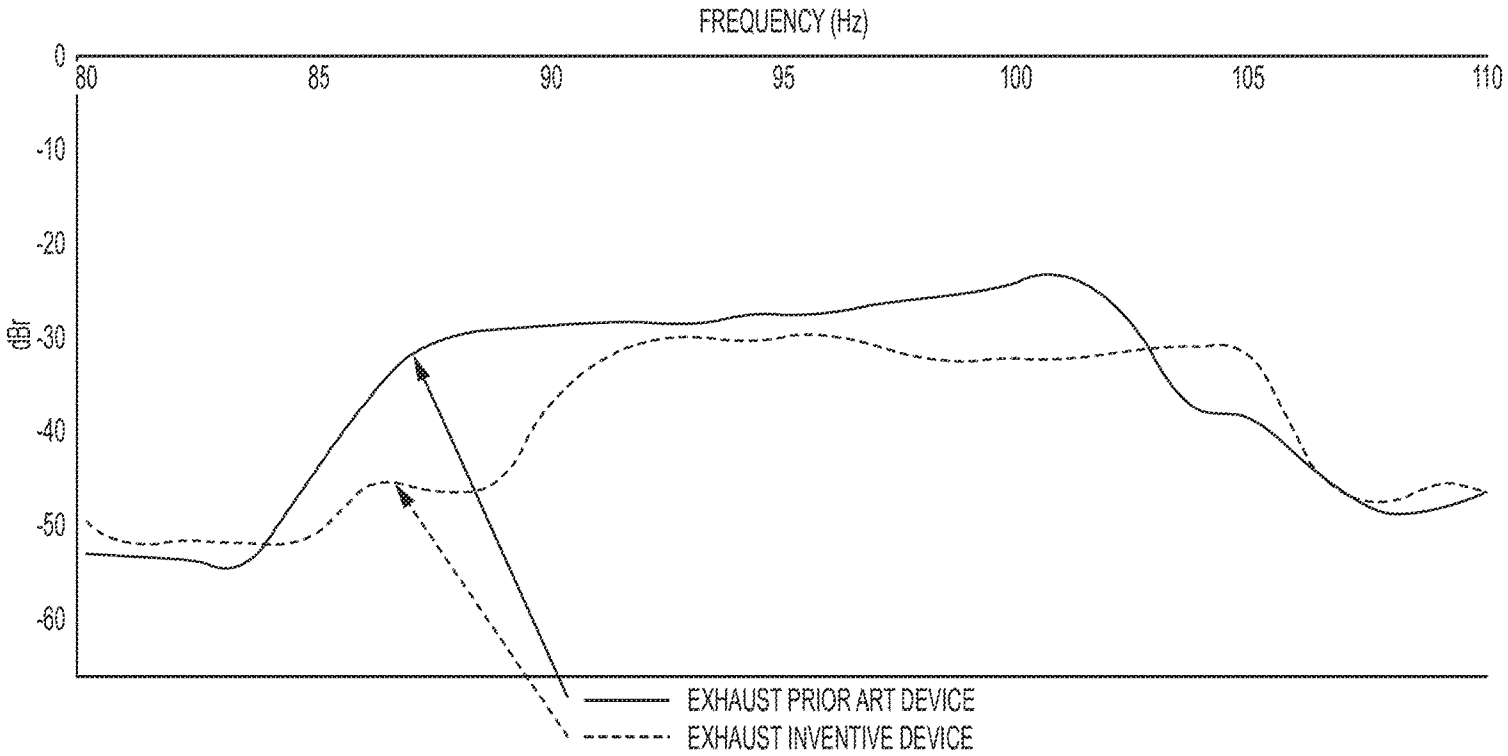
FIGS. 6 and 7 are charts showing signal attenuation as a function of frequency for an exemplary muffler consistent with the teachings of the present invention.
Figure 7:
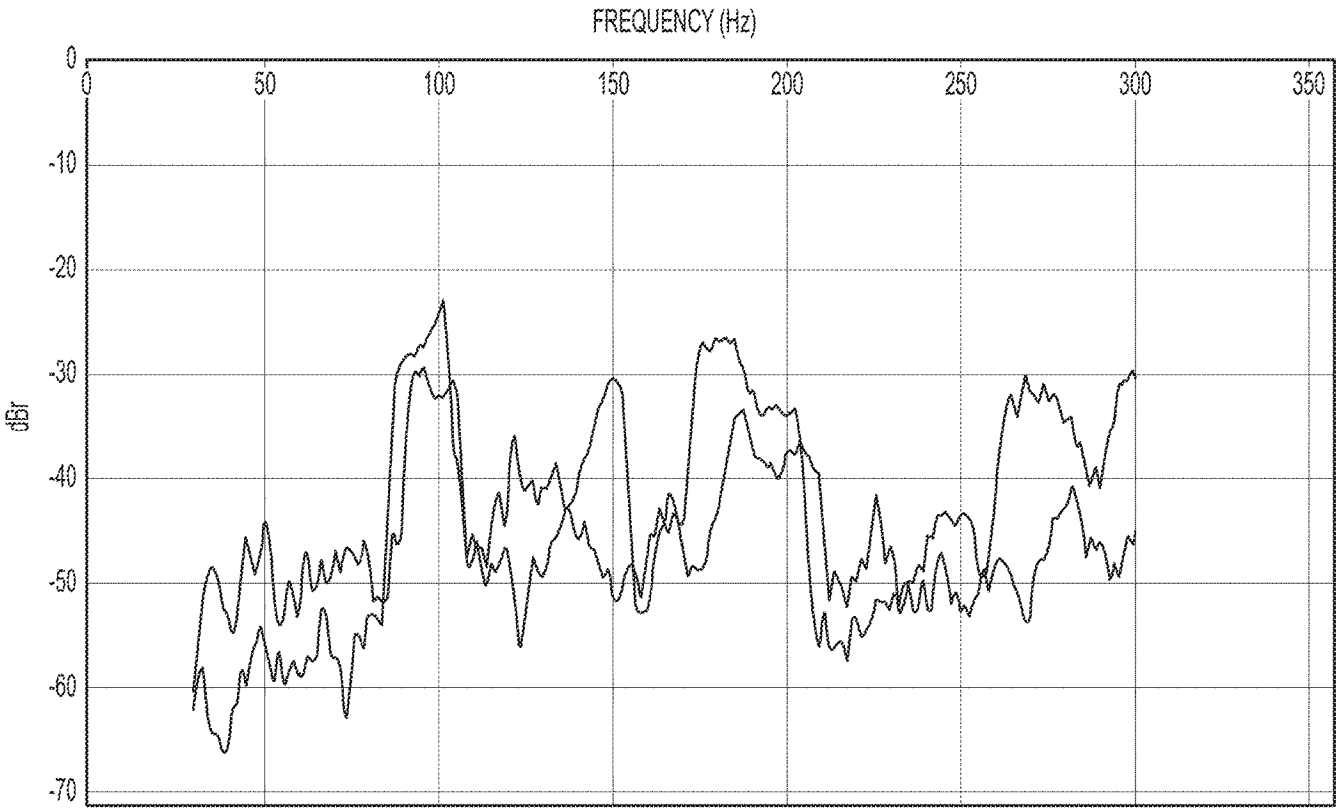

FIGS. 6 and 7 are charts showing noise attenuation (in dB) as a function of frequency for an exemplary reactive muffler consistent with the teachings of the present invention. In the example corresponding to the data shown in FIGS. 4 and 5, undesirable exhaust noise (e.g., "drone") in the range of 90-105 Hz. Using a prior art approach, drone could be reduced by designing a reactive muffler optimized to targeting a single frequency (e.g., 97.5 Hz) within that range. However, doing so would not provide a high degree of noise suppression/attenuation within this range. In the context of the present invention, a single muffler in accordance with the present invention was designed to provide a first volume optimized to function as a reactive muffler to reduce drone at a first frequency 95 Hz, and to further provide a second volume optimized to function as a reactive muffler to reduce drone at a second frequency of 100 Hz. Further, there each resonator provides some noise suppression/attenuation at a range of frequencies encompassing the first and second targeted frequencies. In this embodiment, the target frequencies are closely spaced so that the respective ranges of attenuated frequencies associated with the first and second target frequencies overlap. This overlap results in a noise amplitude reduction across a broader frequency spectrum, and thus provides enhanced noise attenuation over the 90-105 Hz range.

Although preferred embodiments of the invention have been described using specific terms, such description is for illustrative purposes only, and it is to be understood that changes and variations may be made without departing from the spirit or scope of the following claims.

What is claimed is:

1. A muffler providing multi-spectrum attenuation for enhanced noise suppression, the muffler comprising:

a housing comprising:

a skin having a continuous surface defining a tubular member extending longitudinally between opposed open ends;

an upstream end cap joined to said skin to close a first of said opposed open ends, said upstream end cap defining an inlet opening; and a downstream end cap joined to said skin to close a second of said opposed ends, said downstream end cap defining an outlet opening;

a baffle comprising a first portion extending continuously and longitudinally from the upstream end cap to the downstream end cap to divide into at least two distinct cavities an internal volume of the muffler defined by the skin, the upstream end cap, and the downstream end cap, the baffle further comprising a second portion extending transversely to said first portion to define a conduit extending transversely to said skin, each of said cavities having a different volume;

an internal tube comprising a solid tubular body, said internal tube having an outer profile, said internal tube having a length extending from said upstream end cap to said downstream end cap, one end of said internal tube fitting within and being joined to said downstream end cap to provide fluid communication to said outlet opening, said internal tube defining at least first and second openings extending through said tubular body; and a sleeve tube comprising a solid tubular body having a first end having an outer profile fitting within and being joined to said upstream end cap, and an inner profile dimensioned to fit around and be joined to an opposite end of said internal tube, to provide fluid communication with said inlet opening, said sleeve tube having a respective length less than said length of said internal tube, said sleeve tube having a main body portion having an inner profile dimensioned to surround said outer profile of said internal tube to define an air gap therebetween, wherein said first end of said sleeve tube comprises a necked-down portion configured to correspond to and fit closely with an inner perimeter of the inlet opening in the upstream end cap;

wherein said first of said openings of said internal tube provides fluid communication from said inlet opening to said air gap and to a first of said cavities on a first side of said baffle, said first cavity having a first volume;

wherein said second of said openings of said internal tube provides fluid communication from said inlet opening, along said conduit, and to a second of said cavities on a second side of said baffle, said second cavity having a second volume distinct from said first volume; and wherein said cavities are tuned to attenuate different respective spectra of noise associated with pressure waves of combustion gasses passing through said muffler from said inlet opening to said outlet opening.

2. The muffler of claim 1, wherein said sleeve tube is cylindrical.

3. The muffler of claim 1, wherein said internal tube is cylindrical.

4. The muffler of claim 3, wherein said sleeve tube is cylindrical.

5. The muffler of claim 1, wherein each of said upstream and downstream end caps is welded to said skin.

6. The muffler of claim 1, wherein said first opening comprises a pair of openings positioned within an upstream half of the length of said internal tube.

7. The muffler of claim 6, wherein said second opening is disposed within a downstream half of the length of said internal tube.

8. The muffler of claim 1, wherein said pair of openings are evenly radially spaced about a periphery of said internal tube.

9. The muffler of claim 1, wherein said pair of openings are evenly radially spaced about a circumference of said internal tube.

10. The muffler of claim 1, wherein said second opening is disposed within a downstream half of the length of said internal tube.

11. A muffler providing multi-spectrum attenuation for enhanced noise suppression, the muffler comprising:

a housing comprising:

a skin having a continuous surface defining a tubular member extending longitudinally between opposed open ends;

an upstream end cap joined to said skin to close a first of said opposed open ends, said upstream end cap defining an inlet opening; and a downstream end cap joined to said skin to close a second of said opposed ends, said downstream end cap defining an outlet opening;

a baffle comprising a first portion extending continuously and longitudinally from the upstream end cap to the downstream end cap to divide into at least two distinct cavities an internal volume of the muffler defined by the skin, the upstream end cap, and the downstream end cap, the baffle further comprising a second portion extending transversely to said first portion to define a conduit extending transversely to said skin, each of said cavities having a different volume, said second portion of said baffle having an edge abutting said internal tube while providing fluid communication of said second opening with said conduit defined by said second portion;

an internal tube comprising a solid tubular body, said internal tube having an outer profile, said internal tube having a length extending from said upstream end cap to said downstream end cap, one end of said internal tube fitting within and being joined to said downstream end cap to provide fluid communication to said outlet opening, said internal tube defining at least first and second openings extending through said tubular body; and a sleeve tube comprising a solid tubular body having a first end having an outer profile fitting within and being joined to said upstream end cap, and an inner profile dimensioned to fit around and be joined to an opposite end of said internal tube, to provide fluid communication with said inlet opening, said sleeve tube having a respective length less than said length of said internal tube, said sleeve tube having a main body portion having an inner profile dimensioned to surround said outer profile of said internal tube to define an air gap therebetween;

wherein said first of said openings of said internal tube provides fluid communication from said inlet opening to said air gap and to a first of said cavities on a first side of said baffle, said first cavity having a first volume;

wherein said second of said openings of said internal tube provides fluid communication from said inlet opening, along said conduit, and to a second of said cavities on a second side of said baffle, said second cavity having a second volume distinct from said first volume; and wherein said cavities are tuned to attenuate different respective spectra of noise associated with pressure waves of combustion gasses passing through said muffler from said inlet opening to said outlet opening.

12. A muffler providing multi-spectrum attenuation for enhanced noise suppression, the muffler comprising:

a housing comprising:

a skin having a continuous surface defining a tubular member extending longitudinally between opposed open ends;

an upstream end cap joined to said skin to close a first of said opposed open ends, said upstream end cap defining an inlet opening; and a downstream end cap joined to said skin to close a second of said opposed ends, said downstream end cap defining an outlet opening;

a baffle comprising a first portion extending continuously and longitudinally from the upstream end cap to the downstream end cap to divide into at least two distinct cavities an internal volume of the muffler defined by the skin, the upstream end cap, and the downstream end cap, the baffle further comprising a second portion extending transversely to said first portion to define a conduit extending transversely to said skin, each of said cavities having a different volume;

an internal tube comprising a solid tubular body, said internal tube having an outer profile, said internal tube having a length extending from said upstream end cap to said downstream end cap, one end of said internal tube fitting within and being joined to said downstream end cap to provide fluid communication to said outlet opening, said internal tube defining at least first and second openings extending through said tubular body; and a sleeve tube comprising a solid tubular body having a first end having an outer profile fitting within and being joined to said upstream end cap, and an inner profile dimensioned to fit around and be joined to an opposite end of said internal tube, to provide fluid communication with said inlet opening, said sleeve tube having a respective length less than said length of said internal tube, said sleeve tube having a main body portion having an inner profile dimensioned to surround said outer profile of said internal tube to define an air gap therebetween;

wherein said first of said openings of said internal tube provides fluid communication from said inlet opening to said air gap and to a first of said cavities on a first side of said baffle, said first cavity having a first volume;

wherein said second of said openings of said internal tube provides fluid communication from said inlet opening, along said conduit, and to a second of said cavities on a second side of said baffle, said second cavity having a second volume distinct from said first volume; and wherein said cavities are tuned to attenuate different respective spectra of noise associated with pressure waves of combustion gasses passing through said muffler from said inlet opening to said outlet opening; and wherein each of said baffle and said end caps comprise complementary structures acting as alignment fiducials for alignment of the baffle during assembly of the muffler; and wherein said complementary structures comprise a pair of spaced openings and a pair of complementary protrusions.

13. The muffler of claim 12, wherein said baffle comprises said pair of complementary protrusions.

14. The muffler of claim 12, wherein said complementary structures comprise a pair of bosses and a pair of complementary depressions.

15. The muffler of claim 12, wherein said baffle comprises said pair of complementary depressions.

16. A muffler providing multi-spectrum attenuation for enhanced noise suppression, the muffler comprising:

a housing defining a substantially closed chamber except for an inlet opening and an outlet opening;

a baffle comprising a first portion dividing into at least two distinct cavities an internal volume of the housing, the baffle further comprising a second portion extending transversely to said first portion to define a conduit extending between said cavities, said cavities having different respective volumes;

an internal tube extending from said inlet opening to said outlet opening, one end of said internal tube providing fluid communication to said outlet opening, said internal tube defining at least first and second openings; and a sleeve tube having a first end in fluid communication with said inlet opening, and an inner profile dimensioned to fit around and be joined to an opposite end of said internal tube, to provide fluid communication with said inlet opening, said sleeve tube having a respective length less than said length of said internal tube, said sleeve tube having a main body portion having an inner profile dimensioned to surround said outer profile of said internal tube to define an air gap therebetween;

wherein said first end of said sleeve tube comprises a necked-down portion configured to correspond to and fit closely with an inner perimeter of the inlet opening;

wherein said first of said openings of said internal tube provides fluid communication from said inlet opening to said air gap and to a first of said cavities on a first side of said baffle, said first cavity having a first volume;

wherein said second of said openings of said internal tube provides fluid communication from said inlet opening, along said conduit, and to a second of said cavities on a second side of said baffle, said second cavity having a second volume distinct from said first volume; and wherein said cavities are tuned to attenuate different respective noise spectra.

* * * * *